US008018346B2

(12) United States Patent
Gottlieb et al.

(10) Patent No.: US 8,018,346 B2
(45) Date of Patent: Sep. 13, 2011

(54) BACK BEND SENSOR

(75) Inventors: Mark Gottlieb, Fairfax Station, VA (US); Ali G. Ganjei, McLean, VA (US)

(73) Assignee: Mark Gottlieb, Fairfax Station, VA (US)

( * ) Notice: Subject to any disclaimer, the term of this patent is extended or adjusted under 35 U.S.C. 154(b) by 558 days.

(21) Appl. No.: 12/213,450

(22) Filed: Jun. 19, 2008

(65) Prior Publication Data

US 2009/0315721 A1 Dec. 24, 2009

(51) Int. Cl.
*G08B 23/00* (2006.01)

(52) U.S. Cl. ..... 340/573.7

(58) Field of Classification Search ..... 340/573.7, 340/573.1, 689, 686.1; 128/845, 870
See application file for complete search history.

(56) References Cited

U.S. PATENT DOCUMENTS

| | | | | |
|---|---|---|---|---|
| 4,871,998 | A * | 10/1989 | Chaillou | 340/573.7 |
| 4,938,476 | A | 7/1990 | Brunelle | |
| 4,958,145 | A | 9/1990 | Morris | |
| 5,128,655 | A * | 7/1992 | Shore | 340/573.7 |
| 5,146,929 | A * | 9/1992 | Sawhill | 600/594 |
| 5,398,697 | A * | 3/1995 | Spielman | 600/594 |
| 5,749,838 | A * | 5/1998 | Kline | 601/71 |
| 7,843,351 | B2 * | 11/2010 | Bourne et al. | 340/573.7 |
| 2005/0237209 | A1 * | 10/2005 | Van Dongen | 340/573.7 |
| 2009/0058661 | A1 * | 3/2009 | Gleckler et al. | 340/573.7 |

* cited by examiner

*Primary Examiner* — Phung Nguyen
(74) *Attorney, Agent, or Firm* — Davidson Berquist Jackson & Gowdey, LLP

(57) ABSTRACT

A trainable back bend monitor system for use by individuals that will monitor and sense bending as it occurs and where a threshold level of bending can be set so that the individual will be warned when that predetermined threshold, unique to that individual, has been reached so that the individual can then be warned or signaled to stop bending thereby avoiding bending conditions that can lead to bodily strain that can cause lower back pain.

16 Claims, 9 Drawing Sheets

BACK BEND SENSOR

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to apparatus and an approach for formulating use of good body mechanics, including helping to restrict poor posture, or for a given individual to reduce, minimize or eliminate excessive bending. This approach fosters use of good bending techniques and warns when poor posture exists or when too much bending is about to occur so that corrective measures to aid in healing the cause of lower back pain can take place. The approach also aids in the detection of the amount of bending or poor posture an individual is undergoing or experiencing. Included is a way to measure and monitor the amount of bending taking place or when poor posture is actually occurring for that an individual and to signal or warn that individual when too much bending is occurring or is about to occur. Further, when seated posture is incorrect, to detect poor posture and to again signal the seated individual to thereby help the individual learn where and/or when to stop bending or to maintain a healthy and desirable posture to thereby avoid stress, reduce the incidence lower back pain, to achieve better posture and to instill good bending or sitting techniques.

INTRODUCTION

Glossary: A number of terms are used through out this patent and important terms include:

The phrase "Membrane" shall mean a flexible or elastomeric material supporting a strain gauge.

The term "Sensor" shall mean a sensing device to detect incremental changes in the elongation of the L1-L5 lumbar area of the human spine.

The term "patch" refers to any relatively non-stretch item or device that can overlie the L1-L5 lumbar region and when worn will restrict bending or be suitably connected to indicate to the wearer that too much bending of the lumber region is in progress so that bending will be limited, reduced or stopped.

DESCRIPTION OF PRESENTLY PREFERRED EXAMPLES OF THE INVENTION

Brief Description of Figures

The invention is better understood by reading the following detailed description with reference to the accompanying drawings in which.

DETAILED DESCRIPTION

Back pain is a leading cause for health care expenditures in the United States, with more than $50 billion in annual direct and indirect medical expense. Back pain is a principal reason for doctor visits in the United States, and back pain affects more than 10 million people annually. A National Hospital Ambulatory Medical Care Survey of 2001 showed 13,707,000 people in the USA visited a physician's office for primarily back pain or back pain related causes. Back pain is also a principal ailment cited in worker's compensation claims and a principal cause of employee absenteeism in the United States.

Slouching, poor posture and lack of proper bending techniques are leading causes of lower back pain. Consequently, to either reduce the incidence of, to treat or to prevent lower back pain issues one can turn to good posture and use of proper bending techniques rather than waiting to treat after the fact pain and related issues. Controlling the amount of bending can also be useful as part of a course of treatment of lower back pain, where bending can be limited, reduced or stopped for a period of time so that healing can occur. Thus, the application also includes approaches for aiding individuals experiencing lower back pain to limit bending beyond tolerable levels, as part of an overall wellness program or while under the care of a physician.

One form of back pain, Sciatica, is classified as pain along the large sciatic nerve that runs from the lower back down through the buttocks and along the back of each leg. It is one of the most common forms of back pain. Sciatica is usually caused by pressure on one of the roots of the sciatic nerve from a herniated disc (also referred to as a bulging disc, or ruptured disc). This is when the disc has protruded from its normal position in the vertebral column and is putting pressure on the radicular nerve or nerve root (commonly known as a pinched nerve).

Another leading cause of lower back pain is a bulging disc (also called protruding, herniated, or ruptured disc). The inter-vertebral discs are under constant pressure. As discs degenerate and weaken with age, the disc wall can bulge or be pushed into the space containing the spinal cord or a nerve roots, causing pain or paralysis. Studies have shown that most herniated discs occur in the lower, lumbar portion of the spinal column.

Figure 10:
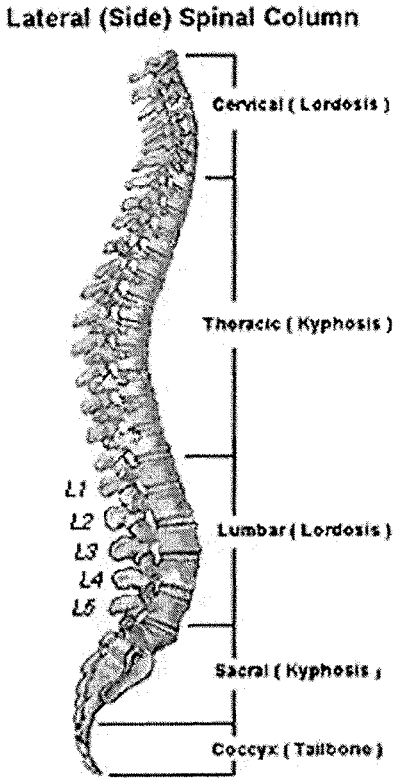
FIG. 10 is a representation of a lateral or side view of a spinal column.
Figure 11:
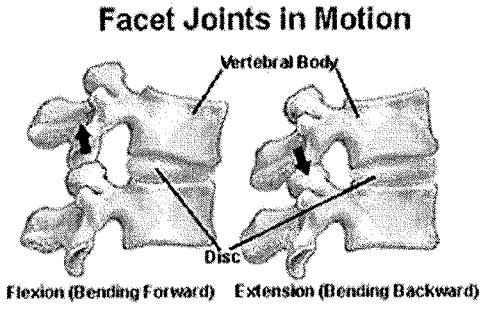
FIG. 11 is a representation of joints in motion, showing forward and backward bending.

Lower back pain can also be the result of poor posture, muscle strain, ligament sprains or inflamed discs or inflamed nerve roots. These discs float between the vertebrae of the spine. In particular, the vertebrae of the lower back or Lumbar area are labeled L1-L5 in the spine as shown in FIGS. 10 and 11.

The area of L1-L5 is naturally concave (lordotic). When an individual suffers from or exhibits poor posture this L1-L5 area changes from a lordotic shape to a straight or convex (kypohotic) shape.

In the corporate and or industrial environment, the issue of lower back pain is being attacked in many shipping departments which have notoriously seen high levels of lower back pain. Many employees are now asked to or are required to wear "lower lumbar back brace support belts" which are designed to manually "pull in" lumbar and abdominal muscles to reduce the incidence of lower back pain. Although the practice of wearing such belts is wide spread in North America a 2-year study, reported by the National Institute for Occupational Safety and Health (NIOSH) in December 2000, found no statistically significant difference in either the incidence of workers' compensation claims for job-related back injuries or the incidence of self-reported pain among workers who reported they wore back belts daily compared to those workers who reported never using back belts or reported using them only once or twice a month. This study also found that those abdominal belts restrict the range of motion during side to side bending and twisting. However, they do not have the same effect when the worker bends forward, as in many industrial lifting situations.

The medical profession is also realizing that these lumber protection belts may actually be counter-productive. People who wear these belts all day long begin to weaken their muscles in the lower back area since those muscles are not exercised as much due to the belts. So, during their off time while not wearing the belt, their weakened lumbar muscles are more vulnerable to strain.

An underlying premise herein is that bending over by individuals also has a cumulative effect on the discs of the lower back, and in particular on the L1-L5 discs (the bottom 5 discs of the vertebrae). Every time someone bends over, that bending or flexing of the discs is one more increment in the count toward herniation where the discs between L1-L5 become herniated and potentially impinge upon a nerve root. Further each person is genetically predisposed, to a different degree, with a certain count for how many times they can bend over and stress the discs between the vertebrae. Clearly time plays a factor in this equation, but there is a cumulative effect of bending over on the discs between the lower vertebrae. Consequently, if one was never to bend over that would significantly reduce the incidence of lower back pain. Therefore, if bending was lessened or done correctly without putting undue stress on these discs and the adjacent soft tissues (muscles, ligaments and tendons) between the L1-L5 vertebrae, the incidence of lower back pain would be dramatically reduced.

It has been determined that the length of the L1-L5 vertebrae will lengthen one inch in a typical full grown 6 ft male when that individual is fully bent over relative to an erect standing position. This will also result in a proportional degree of skin movement as the bending takes place.

Figure 2:
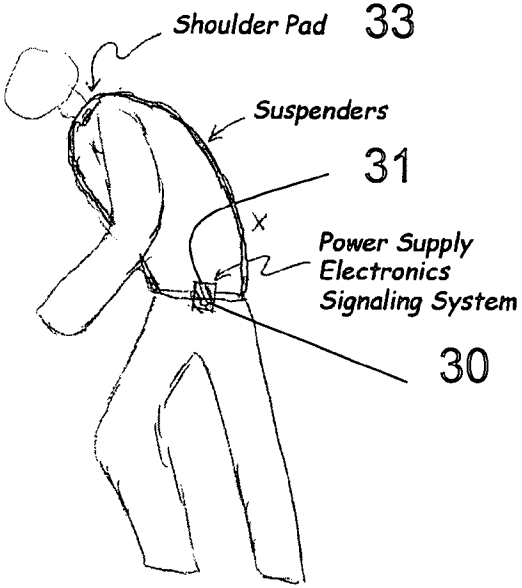
FIG. 2 is an elevational view of an individual bent over.
Figure 1:
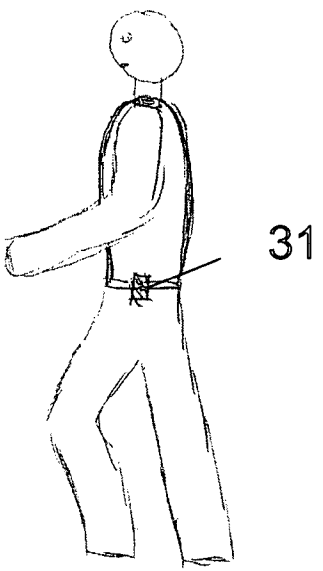
FIG. 1 is an elevational view of an individual in an upright position.

Consequently, as one aspect of the invention we have developed an approach to monitor the lengthening of the body adjacent the L1-L5 vertebrae, as is demonstrated by comparing the position of the body between FIG. 1 and FIG. 2, and to sense when, for example, the vertebral length itself lengthens, or when the skin overlying the area at L1-L5 lengthens, thereby indicting vertebral lengthening. When the amount of bending approaches a predetermined amount or threshold the person being monitored will need to be notified by some signal or stimulus that they are bending over too far or that their posture is not as it should be and may lead to back pain. The stimulus can be of a variety of types and would depend on the desire of the market and/or the individual involved.

In one form, the monitoring apparatus is based on four parts: 1) a sensor housing or structure; 2) a power source; 3) a sensor portion and an operational controller; and 4) a signaling or stimulus system. A simpler version is described hereafter relative to FIG. 9.

The apparatus will be deployed on or adjacent a portion of a person's lower back. The apparatus can use electronics to monitor and sense the amount of bending and the stretching of the lower back, and a power source, for example, suitably sized small batteries.

Figure 3:
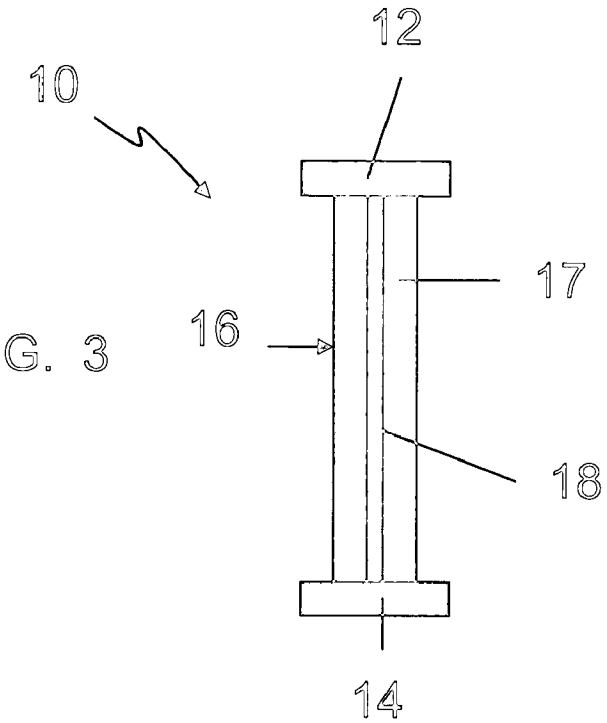
FIG. 3 is a front elevational view of one back bend sensor embodiment of the invention.

FIG. 3 shows one form of the apparatus 10 comprised of upper and lower connection points, such as webs 12 and 14. When properly positioned for use the upper web 12 is preferably located above the L1 position, and the lower web 14, below the L5 position. A membrane 16, positioned between webs 12 and 14, would then be located approximately in the middle of those two positions and would overlie L1-L5. When worn and properly located as just described, the membrane will be stretched or moved as a consequence of the individual bending over and as the lower back is likewise incrementally stretched or lengthened. This membrane 16 can be formed, for example, from a fabric 17 or other flexible or elastomeric material, including, for example, man made materials, including but not limited to plastics, threads, yarns, sheets or woven or knitted materials. Membrane 16 further includes within its structure, or adhered thereto, for example by an adhesive, one or more strain gauges 18 or other form of a sensor that will either be physically stretched or otherwise moved as the fabric 17 is itself stretched and/or moved as a consequence of bending. That stretching of the strain gauge 18, which in this embodiment is part of the sensor system 22 shown in FIG. 8, can be monitored by a controller 23 that is operatively connected thereto so as to produce an electrical signal corresponding to incremental movements of strain gauge 18 or movement of fabric 17. Once a predetermined threshold level of movement has been detected the signal system 25 can be activated and a signal generated warning the individual that the bending limit or threshold has been reached.

Figure 8:
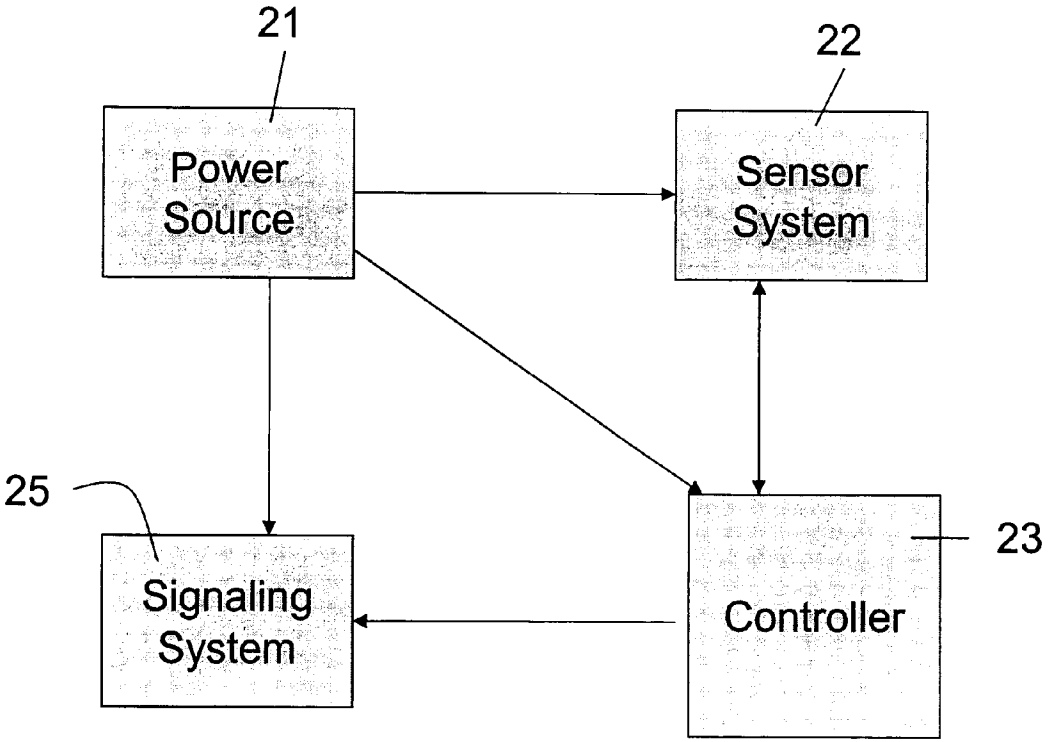
FIG. 8 is a diagrammatic control circuit.

FIG. 8 shows four system elements that are included within each embodiment herein disclosed. These elements include a suitable power source 21, a sensor system 22, a controller 23 that will control and operate the other elements in the device and a signal system 25. All of these elements can be encased in a single housing, for example, as a part of and directly on the device as worn by an individual. Alternatively, the power supply 21, the controller 23 and signal system 25 could be in a separate housing 31 which could, for example, be worn on an individual's belt as shown in FIG. 2, or slipped into a pocket, with the sensor being retained on or formed within the membrane 16 and connected to the housing by a simple wired or wireless connection. Alternatively, they could each be retained in different housings with each of those being located as desired.

In one form, sensor system 22 can reside adjacent the lumbar area, e.g., in the L1-L5 region, for example, by being on suspenders, by being positioned or held there over by any convenient means, such as by being adhered to the individual's back and so on. Sensor 22 can comprise the strain gauge 18. Alternatively, sensor system 22 could include an electronic or optical sensor and sense or detect incremental changes in its own movement or due to movement of an observed image. For example, where the sensor itself may be moved, the sensor can detect electrical changes in resistance, such as MEMS Resistance, changes in capacitance, inductance, magnetism, for example by sensing changes in the position or movement of magnetic marks or indicia caused by bending, by using IR, sending pressure changes or other sense-potential reactions to bending movement, or by other sensing techniques including, but not limited to, ultrasound, photoelectric, RF, temperature, PIR, etc. As another example, where the sensor sees a two or three dimensional image, what may be detected is some incremental physical change in the sensor's position or other relative movement as may be caused by and would be indicative of the amount of bending. Thermal Sensor arrays can also be used, for example, as manufactured by ATMEL and could be of a silicon die type including pixels of pyro-electric material sensitive to temperature differences. Further, optical scanners could be used, for example, of a type manufactured by NEC and MITSUMI, or alternatively they could be a type of linear optical sensor is known as a Scanistor, or be a strip-shaped unit called a multi-junction Scanistor which is comprised of a linear, integrated-circuit array of photodiodes. This device provides an output either as a sequence of pulses which represent spatial sampling of a line image at a discrete number of points, or as an analog wave-form which is a linear transformation of the line image and thus register location changes in such lines.

At the IEEE International Electron Devices Meeting (San Francisco, Calif.; Dec. 13-15, 2004), a research team from the University of Tokyo led by Takao Someya and Takayasu Sakurai described a flexible scanner based on organic photodiode and transistor technology. Instead of mechanical or optical components, such as focusing lenses, such a flexible scanner comprised a "sheet image scanner" and included a 2-D array of organic photodiodes integrated with organic field-effect transistors on a plastic film in which the transistors scan the photodiodes electronically, avoiding the need for moving parts or a line-by-line mechanical scanning procedure.

Such flexible scanner can be as small as a pocket-size device with an effective scanning area of 4×4 in. and with a resolution of 36 to potentially 250 dots per inch (dpi). The photo-detectors could, for example, detect black and white tones by sensing the difference in reflected light from the dark and bright areas of an image, and the thin-film pentacene transistors have an 18-μm channel length and electron mobility of 0.7 $cm^2$ N-s. This type of flexible scanner can sense bent images and could be used to sense movement in a individual's bending back as bending takes place, especially where the scanner was adhered to the individual so as to register bending movements.

Web 12 could be held in place by a number of techniques including, but not limited, to suspenders, by an undergarment, for example a bra, or under pants.

The bottom or lower web 14 could be attached to a belt, to the upper portion of pants or to an undergarment that would not be so resilient that the sensor membrane will itself not stretch as bending occurs.

Thus, webs 12 and 14 should be held, retained, supported or positioned in a way that will assure that as bending occurs it is the strain gauge 18 itself that moves or stretches in proportion to the amount of bending taking place so that incremental changes in bending can be sensed and monitored.

Where suspenders are used to hold top web 12, they will have to be sufficiently strong or non-elastic to ensure that strain gauge 18 or sensor itself will itself be affected by bending motion in proportion to the amount of bending that is taking place, or even when the individual is slouching or holding a bent condition for some period of time.

Also, while the signal from signal system 25 is preferably triggered when the amount of bending reaches a predetermined threshold, a delay of a second or two might be useful in some situations especially where the degree of bending is for a very short duration and only just at the threshold limit. Further, a signal can be triggered when the individual bends less than the threshold degree, but is close to that threshold or holds the bent condition for more than a prescribed period with the signal then indicating a poor posture condition that has continued for that period of time.

Further, the suspenders could also be provided with pads 33, as shown in FIG. 2, that would minimize slippage between an individuals skin or clothing as bending occurs. Such pads could be formed from rubber, Velcro or other anti-slip material to help assure that bending stretches the sensor.

Figure 4:
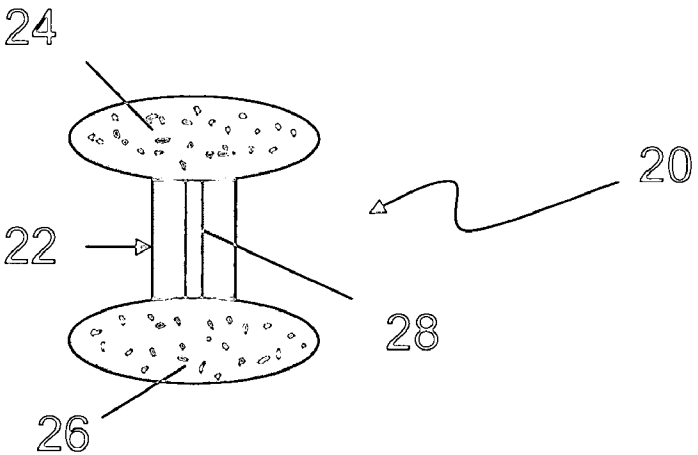
FIG. 4 is a front elevational view of another back bend sensor embodiment.

FIG. 4 shows another approach for a bend sensing device 20 where a membrane 22 having a sensor 28 operatively mounted thereto is connected to upper and lower patches or adhesive pads 24 and 26, respectively with the adhesive being shown by stippling. This device 20, which could collectively be called a patch, would be periodically applied to a person's lower back and over the middle of the back so that patch 20 and sensor 28 would cover or be centered over the L1-L5 area. Patch 20 would incorporate the sensor 28 that could, for example, be in the form of a strain gauge that will be stretched in response to movements reflecting a bending condition and produce an electrical signal corresponding to incremental bending movements. When such movement is sensed to be either approaching or just beyond a desired or preset amount by controller 23, a signal can be generated that will again activate the signaling system 25 to create a signal to warn or alert the individual that too much bending is occurring. The structure of patch 20 can be formed to include each of the power source 21, sensor system 22, controller 23 and the signaling system 25 as a one piece device. Alternatively, one or more of the power source 21, controller 23 and the signaling system 25 could be housed in a separate housing, as shown at 31, and be electrically connected to patch 20.

Figure 5:
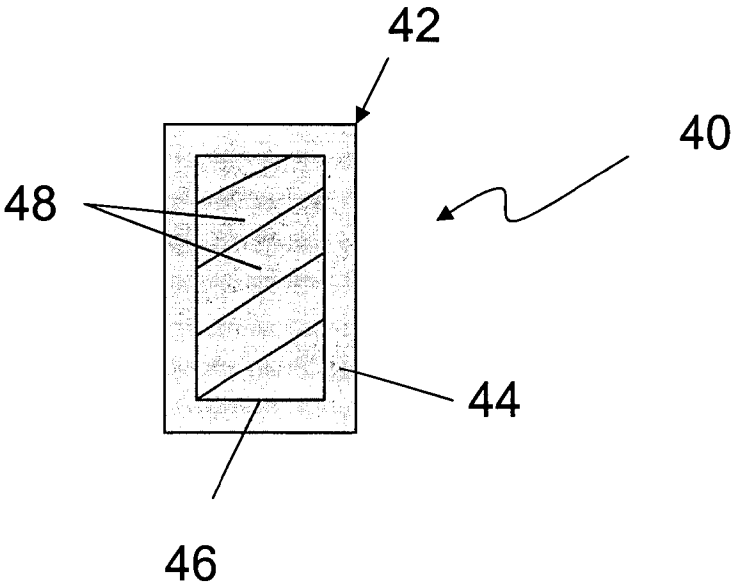
FIG. 5 is a diagrammatic representation of a sensor patch.
Figure 6:
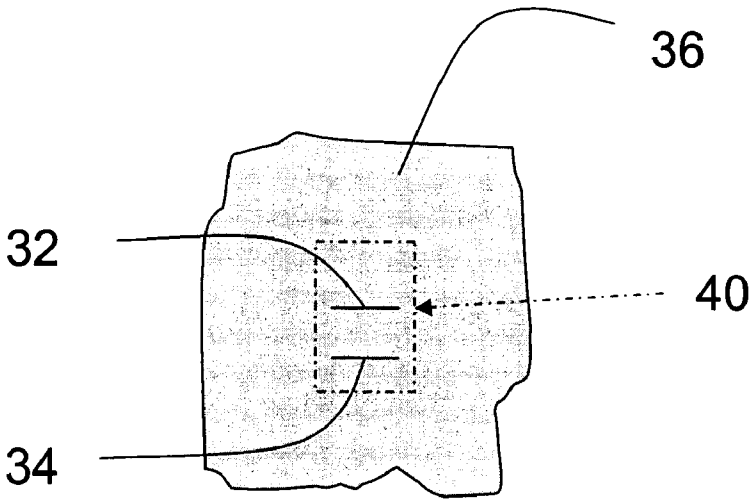
FIG. 6 is a view of the patch shown in FIG. 5 as used on an individual.

FIGS. 5 and 6 show another approach for a back bend sensor 40. Here, two or more lines, as indicated at 32 and 34 in FIG. 4, can be drawn or otherwise placed on an individual's back, as is diagrammatically shown at 36 in FIG. 6. Marks or lines 32/34 could, for example, be made by using a permanent black ink or other visible marks, including, for example, adhesive strips that can be placed on the lower back area, or by use of inks that might be otherwise invisible to the eye but are detectable by sensors. What is important is that the marks 32/34 be suitably detected by the sensor being used to produce a signal equivalent to the incremental movement caused by bending of the spine. Marks 32 and 34 can be renewed on an individuals back area periodically, for example every few days or once a week as needed, so that they remain detectable to the sensor. These marks 32 and 34 would preferably be two or more in quantity, they would be spaced apart with the spacing there between ranging from about one eighth of an inch to about two inches and they would be positioned over and preferably extend across portions of the L1 and L5 region. Back bend sensor 40 could take the form of a flat, thin flexible plate or cover 42, for example made from a fabric or plastic material, with an adhesive outer edge 44 which is placed over the Loradic area. Back bend sensor 40 includes a central panel 46 on one side facing the individual which can be comprised of, for example, a plurality of sensor strips 48, as a part of the sensor system 22, designed to optically or electronically 'see' marks 32 and 34 so that controller 23 could determine incremental variations in the spacing there between as bending occurs and the skin where the marks 32 and 34 have been made stretches and moves the marks apart. Consequently, panel 46 and its sensors 48 and the controller 23 will collectively track changes in the relative distance between marks 32 and 34 as the individual wearing the back bend sensor moves. Increases in distance between the marks 32/34, when detected to be above a certain predetermined threshold amount, would trigger the generation of a signal to the signaling system 25 and activate the signal system 25 to produce its warning signal or stimulus.

The cover 42 could be a few inches wide and 6 to 10 inches high with sensors 48 on the interior panel 46 covering a smaller area to detect the marks 32 and 34. Detecting could also occur by using optical reflection methods, depending upon the material used to make marks 32 and 34, or by using ink that is magnetic. Sensors 48 could, in turn therefore be comprised of a field of optical sensors that would see a reflection by certain types of marks, or follow the movement of marks formed from magnetic ink by a matrix of magnetic sensors that could determine the spacing between the lines and sense incremental changes in that spacing. The ink for marks 32/34 could also be invisible to the eye, but detectable to the sensor 48, i.e. an ultraviolet ink dye for instance.

The panel 46 for back bend sensor 40 could, in addition to containing sensors 48, also contain or include the suitable power source 21, controller 23 and the signaling system 25. Alternatively, one or more of the power supply 21, controller 23 and signaling system 25 could be housed or contained in a separate structure or housing 31 and be mounted or carried else where on the individual. Positioning of the back bend sensor 40 over the Loradic area could be accomplished using a variety of methods including having the cover 42 be held to the individual's skin by a suitable adhesive, for example, typical of those used on band aids or other stickable bandages which will adhere to the skin of a human for a number of days, or formed as part of a suspenders system or being part of an undergarment that locates back bend sensor 40 in the approximate position relative to the L1-L5 area or even attached to a belt system which holds it in the approximate location.

Once more than the predetermined minimum amount of movement or threshold limit has occurred due to bending, the approaching condition equating to an incorrect posture would be detected and the individual could then be warned that any further bending would be excessive. It should be understood that each device could be tailored or tuned to an individual, as is further described hereinafter, so that the device and/or system would learn to sense or detect movement unique for that individual. This way, each device or bend sensor will effectively perform as needed or desired for each individual.

The power source 21 is preferably a suitable battery, as the person will most likely want to be mobile, and the battery could be, for example, either rechargeable or primary cell. Since the sensor, signaling system and controller are expected to draw very low levels of power, for example on the order of 1 mAh, a single AAA sized battery is expected to supply enough power for many weeks of operation.

There are a few preferred methods of measuring the bending of the Loradic L1-L5 area prior to getting beyond a safe limit. These include having an elastic membrane like straps 16 or 22, a patch like 40 or other device with a built-in strain gauge or other form of sensor that will react proportionally to incremental increases in length of an elastic membrane or movements caused by bending.

Once the controller has determined a level of change corresponding to a preset minimum amount or a set threshold level or amount of bending of the Loradic area, the system needs to signal the user of the approaching condition to signal bending should stop. This can be done by any one of a series of conventional methods including auditory signals, vibration, or electrical stimulation of the skin (light electric shock).

For the auditory signal a sound producing device could be activated by signal device 25 to beep or make a sufficiently loud auditory sound to notify the person that they are about to be bending over too far. A vibrating signal would give the user notice without bringing attention to others in the area. If an electrical shock or other form of electrical stimuli were to be used the charge should only be sufficient to cause a 'tingle' or enough of a sensation so that the person would notice the applied sensation and thereby realize that they are bending over too far. The level of electrical stimulation would be sufficient to be annoying, but not at a level that would be harmful. In each of the foregoing embodiments, once an incorrect posture is detected, using one of the aforementioned techniques, the goal is to signal the user that their position is wrong or is approaching a poor or incorrect posture position for that individual.

An additional part of the system is to be able to learn for any particular individual what for that person is a normal good position and a poor or 'bent too far over' position. Since each person will be built differently, and since we want the system to be mounted to the person in a way that will permit the sensor to move in proportion to bending, the system may be taught what equals a normal upright position and when a 'bent over too far' position for a person has been reached. From this point, it will be able to make determinations as to when to stimulate the user of poor posture to thereby help that person learn new habits and to reduce the movements that will likely result in lower back pain.

This learning could occur in a variety of ways. For instance a learn routine could be activated by pushing a learn button, as shown at 30 in FIG. 2, that when pushed will generate one or a series of position location signals indicative of a level or an amount of relative movement that can be stored within a suitable memory contained within controller 23. Button 30 can be provided at a convenient location on a housing 31 for the system, for example on the housing 31 worn on the belt as shown in FIG. 2 with a learning cycle being initiated when initial use of the system begins.

The learn routine would assume you are always starting out at a good position, which position can be input into the memory of controller 30 via button 30 and the sensor system 22. Then, over a time period, for example the next few seconds, the individual can bend and with the amount of bending movement being sensed by sensor system 22 signals from pushing learn button 30 will set a limit for that individual's bending within the memory of controller 23. That bending limit will become the bending threshold equal to a level of or amount of bending movement that will be at the outer limit for that individual, on that day or for that period of use of the bend sensor device. That bending threshold as stored in memory will be a level of bending movement to be used for comparison purposes relative to subsequent movement sensed by sensor system 22. That particular bend threshold can then be used as a set point for subsequently initiating activation of a signal that a level of bending is occurring beyond the set limit thus warning the individual that the preset or learned bending threshold has been reached and that the individual is now experiencing or is about to experience a poor posture position. This simple learn technique allows for very easy tuning or adjustment in the field so that each device can be set to a particular individual's needs when it is put on and use begins for that day.

Another modification would be for the bend sensor system, for example in controller 23, to store in a suitable memory, for example a flash memory, all of the resulting bend data it sees during a day, a week or during some chosen time frame, and to have the memory system included within the controller 23 be accessible so that the data contained therein could be downloaded or transferred, for example, to one's physician for review of the accumulated data.

Figure 7:
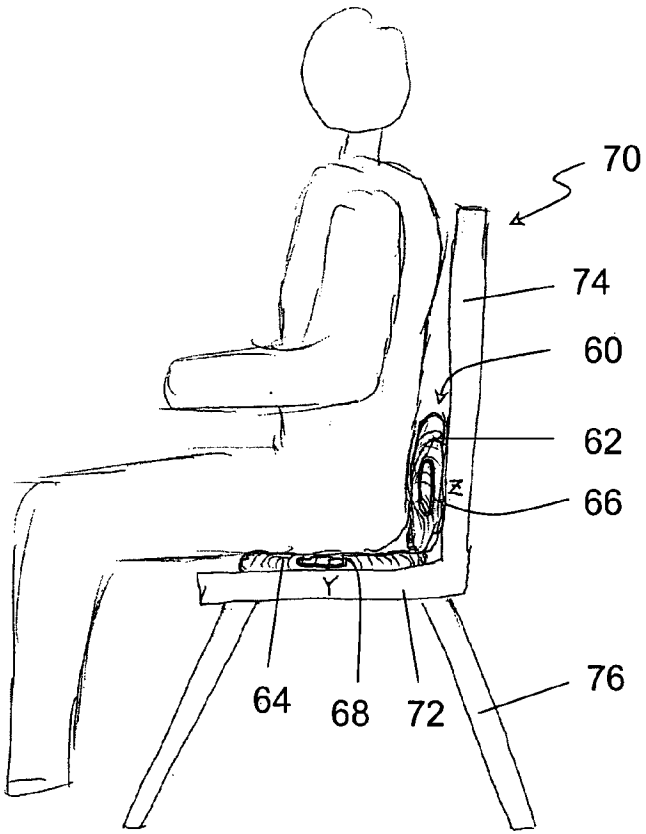
FIG. 7 is a chair embodiment.

Turning now to FIG. 7 bending sensor apparatus can also be configured for use in a chair or various types of seating, including automotive seating, to assist seated users in achieving and practicing good sitting posture when they initially take a seated position as well as in maintaining that good sitting posture over time.

Since the two highest labor categories for incidence of lower back pain are secretaries and individuals spending long periods in vehicles, e.g., cab drivers, police, truck and bus drivers, as examples, it would be advantageous to offer a bend monitoring or seating posture monitoring device for these persons which helps insure good sitting posture and which will assist them in avoiding lower back pain.

A device, generally shown at 60, can be for a chair 70 having a seat pan 72, a seat back 74 and legs or a support system 76. The device 60 can be placed at the back of one's chair or seat and be shaped so as to give good upright posture when sitting. The device 60 can include at least a seat back portion or pad 62 which is preferably located at the back of the chair, and above the seat pan 64, and with a suitable pressure sensor 66, for example located internally within the pad 62, can determine pressure of the individual sitting fully back against pad 62 adjacent the Loradic area of the persons back. While the amount or level of pressure to be sensed can vary, it is expected that the pressure can range from about half a pound (0.5 lb) to about ten pounds (10 lb) with the preferred range being about two pounds (2 lb) to about 4 pounds (4 lb). When an individual is not bent forwardly too far but is properly seated in an upright condition and close or fully back against the seat back 74 that good posture will produce a sensed pressure on sensor 66 within the above ranges. If not, perhaps due to eh individual bending forward away fro the seat back 74, then less than good posture is being realized and a signal can then be initiated to alert the individual to return to an unbent or upright good posture position.

Alternatively, the device 60 could be in the form of an "L" shaped pad system having the seat back portion 62, as described above, as well as a seat pan portion 64 that includes a pressure sensor 68. Portions 62 and 64 collectively detect pressure on both the seat pan and at the seat back at the Loradic area. It should be understood that one or more sensors can be used in each of the portions 62 and 64 to determine pressure between the back and/or seat and the person. Sensing methods could include: pressure sensors; optical sensors; proximity sensors; capacitance, inductance or resistance; as well as temperature sensors (i.e. of the heat being transferred from the back to the sensor).

Sensors 66 and 68 will be part of the sensor system 22 and be electrically connected, by wiring or by a suitable wireless connection, the power supply 21, to controller 23 and to the signaling system 25 so pressure conditions and changes therein can be monitored and so that suitable warning of incorrect seating can be given.

One of the objectives is in determining if there is an adequate amount of pressure against the device by sensing if the person is sitting in an upright position, and in a good posture position. In the version having only the seat back pad 62 pressure sensor 66 will sense when the individual is sitting in an upright condition and fully back against the seat back 74. If not, than a signal can be triggered.

In the "L" shaped model, an additional input from sensor 68 in the seat pad 64 will advise the system controller 23 when the person is sitting or not. If the person is sitting on the chair then controller 23 looks to see whether sensor 66 at the back of the chair is activated signaling a correct position. However, if the person stands up the system would then not require the back portion to be triggered for a proper position. Assuming the person is seated in the chair, once an incorrect posture is detected; using one of the aforementioned techniques the user will be signaled that their position is wrong.

An additional part of the invention is for the seated version of the bend monitoring system to also learn what a normal good posture position is for the seated individual. Here again, the above described learn procedure can also be employed here so that the device and controller 23 can learn what a normal upright position is for the current user and when a 'bent over too far' position or condition exists. From this point the system will be able to make determinations as to when to signal or stimulate the user to avoid poor posture.

The preceding examples have involved the monitoring and sensing of the amount of bending and in response to an excessive level for an individual generating a warning signal for that individual to stop or limit bending.

Figure 9:
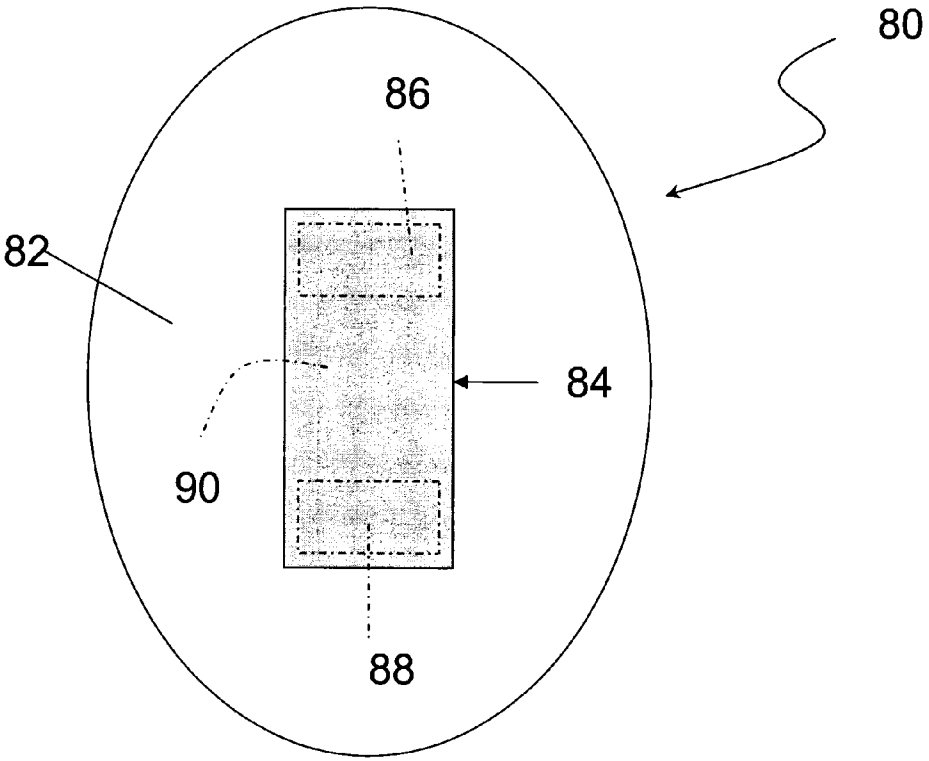
FIG. 9 is a diagrammatic view of a portion of an individual's back and a corrective patch.

Another aspect of this invention includes a perhaps simpler approach generally shown at 80 in FIG. 9. The individual's back, a portion of which is shown at 82, includes a patch 84 which can be, for example, an elongated bandage made from a variety of woven, plastic or other materials or combinations of materials, that provide a relatively non-stretch patch.

Patch 84 can have its entire rear surface coated with an adhesive, or more preferably, the adhesive can be located in separate discrete portion 86 and 88 adjacent the opposing ends of patch 84. This arrangement leaves an adhesive free region 90 there between that will move against the individual's skin. Where adhesive portions 86 and 88 are used the intervening portion 90 of patch 84 will be free of adhesives thereby permitting that adhesive free region 90 to slide over a wearer's skin between the adhesive are 86/88. This makes removal an easier and less painful process, can reduce or minimize any adhesive issue.

It is contemplated that patch 84 could be worn during the day yet be removed at night. This will permit showering, further reduce affects as may be associated with adhesives and yet provide corrective effects when the wearer is active.

Patch 84, for an average six foot normal male, is preferably an elongated patch and can be about six (6) inches long and about three to four (3-4) inches wide. Patch 84 could, of course, vary in size from one that is three to ten (3)-(10) inches long and two (2) to eight (8) inches wide, depending on the size of the individual and the level of bend control desired.

When worn, patch 84 will be adhered to a wearer's back so as to overlie the L1-L5 region. Patch 84 will be applied when the wearer is in an erect upright position. Then, as bending occurs, the skin in the lumbar area will stretch. With patch 84 in place, that bending will pull and stress patch 84 and the adhesive areas 86/88 will resist movement and the relatively non-stretch patch material will become taught. This will pull against the individual's skin, it will restrict further bending and the non-stretch material of patch 84 will pull hard enough to let the wearer know that he or she is attempting to bend too far. The pull on the skin may be painful but that condition will stop as soon as the bending level, or excessive bending, ceases.

It has been found that individuals experiencing lower back pain can wear the patch and that it influences proper levels of bending, given their conditions. This patch 84 provides a simple corrective influence telling the wearer that too much bending is happening. By wearing patch 84 an individual with lower back pain will be aided to know when he or she has arrived at the desired limit of bending and thereby avoid the stress that would otherwise result from bending an excessive amount. As a consequence, by having a simple warning as the non stretch patch 84 provides, better body mechanics can develop and healing can occur.

It should be understood that bending limits or what may equate to excessive bending, will vary from individual to individual. Further, for a given individual what is excessive bending may vary over time or circumstance. When an individual is healthy and not experiencing any lower back pain issues, bending over a wide range may not be excessive. However, should events result in lower back pain or an overstressed back or spine, then even minor amounts of bending may, for a period of time, be excessive. In each of these situations, the present invention, either in the sensor form, the patch form or both, will be effective to aid healing and to assist in promoting not only proper posture, but good body mechanics as well.

It should also be understood that the patch or the sensor back bend devices disclosed herein can be used as part of a wellness regimen to prevent back pain or an over stressed lower back, when an individual is actually suffering from back pain and needs aid in controlling bending to allow healing to take place or as part of treatment program by a doctor for back or back pain issues, with a doctor being able to set bending limits and to monitor the patient's bending, or following surgery to foster good posture and to permit the patient's back to properly heal.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A device for aiding bending control and that will signal a wearer when excessive bending is occurring comprising:

an elongated member formed with at least a center section comprising of a material that can be provided with controlled stretch; and an adhesive layer on designated portions of a rear surface of the member to adhere the member to the skin of an individual so that the member can be positioned over the lumbar region of the individual's substantially erect back and at least the center section will be stretched a controllable amount and when taught will pull against the wearer's skin to warn when bending limits have been reached.

2. The device as in claim 1 where the adhesive is located in two opposed and spaced apart areas adjacent opposing ends of the member with the intervening area of the member being adhesive free.

3. The device as in claim 1 wherein the center section further includes:

a sensor positioned adjacent the spine so that as the spine is bent the amount of vertebral movement will be sensed;

a controller operatively connected to the sensor for determining the amount of vertebral movement and for generating a signal in response to the sensed movement caused by bending;

a signal system actuated to warn a wearer of the device of bending levels in response to a signal from the controller related to the detection of vertebral movement; and a power supply operatively connected to the sensor, the controller and the signal system.

4. The device as in claim 3 wherein the sensor comprises a stretchable member.

5. The device as in claim 3 wherein the sensor comprises a member including therein a strain gauge that is incrementally strained as bending occurs.

6. The device as in claim 3 wherein the sensor comprises a patch that is adhered to an individual and senses incremental changes in spacing between at least two marks placed on the individual beneath the patch.

7. The device as in claim 6 wherein the patch further includes a sensor panel containing one or more optical sensors.

8. The device as in claim 7 wherein the optical sensors monitor the spacing between the at least two marks.

9. The device as in claim 6 wherein the patch further includes a sensor panel containing one or more magnetic sensors.

10. The device as in claim 9 wherein the magnetic sensors monitor the spacing between the at least two marks.

11. The device as in claim 3 wherein the sensor comprises a patch located adjacent a lumbar area of an individual and includes a sensor panel containing one or more sensors.

12. The device as in claim 11 wherein the one or more sensors are optical sensors.

13. The device as in claim 3 wherein the signal system is activated when the amount of sensed vertebral movement exceeds a predetermined threshold.

14. The device as in claim 3 wherein the controller further includes a suitable memory and a bend threshold input for generating a signal to be stored in the controller memory equal to a chosen threshold of sensed bending movement for an individual to thereby permit activation of a signal when subsequently sensed movement is equal to or beyond that set threshold.

15. The device as in claim 1 which is positioned and held adjacent the L1-L5 lumbar region of an individual.

16. A method of helping to control bending by an individual comprising the steps of forming a member of a relatively non-stretch material;

applying adhesive to a rear surface of the member; and applying the member to overlie the L1-L5 lumbar region of the individual's back so that the member will pull on the wearer's skin when bending limits have been reached.

* * * * *